US008618726B2

(12) United States Patent
Cho et al.

(10) Patent No.: US 8,618,726 B2
(45) Date of Patent: Dec. 31, 2013

(54) FIELD EMISSION PANEL, LIQUID CRYSTAL DISPLAY HAVING THE SAME, FIELD EMISSION DISPLAY HAVING THE SAME AND METHOD FOR PACKAGING FIELD EMISSION PANEL

(75) Inventors: Hyun-seung Cho, Anyang-si (KR); Jun-ho Sung, Seoul (KR); Sang-hyuck Ahn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/216,594

(22) Filed: Aug. 24, 2011

(65) Prior Publication Data

US 2012/0049722 A1 Mar. 1, 2012

(30) Foreign Application Priority Data

Aug. 25, 2010 (KR) ..... 10-2010-0082500

(51) Int. Cl.

| | |
|---|---|
| ***H01J 1/62*** | (2006.01) |
| ***H01J 9/26*** | (2006.01) |
| ***H01J 61/30*** | (2006.01) |
| ***H01J 63/04*** | (2006.01) |

(52) U.S. Cl.
USPC ..... 313/495; 445/25; 220/2.1 R

(58) Field of Classification Search
USPC ..... 313/495; 445/25; 220/2.1 R
See application file for complete search history.

(56) References Cited

U.S. PATENT DOCUMENTS

| | | | | |
|---|---|---|---|---|
| 6,218,777 | B1 | 4/2001 | Jones et al. | |
| 2004/0251813 | A1 * | 12/2004 | Okai et al. | 313/495 |
| 2006/0087217 | A1 * | 4/2006 | Kijima et al. | 313/493 |
| 2006/0238107 | A1 * | 10/2006 | Kim et al. | 313/496 |
| 2007/0087545 | A1 * | 4/2007 | Wada et al. | 438/612 |
| 2007/0228928 | A1 * | 10/2007 | Min et al. | 313/495 |
| 2008/0116809 | A1 | 5/2008 | Park | |
| 2009/0015132 | A1 * | 1/2009 | Cheng et al. | 313/495 |

FOREIGN PATENT DOCUMENTS

| | | | |
|---|---|---|---|
| EP | 1345251 | A2 | 9/2003 |
| FR | 2705163 | A1 | 11/1994 |
| JP | 2004179030 | A * | 6/2004 |

OTHER PUBLICATIONS

English translation of Description of FR 2,705,163 A1.*
European Search Report issued Jun. 30, 2011 by the European Patent Office in corresponding app. No. 11162806.1.
J.W. Alpha, 'Glass sealing technology for displays', Optics and Laser Technology, Dec. 1976, pp. 259-264.

* cited by examiner

*Primary Examiner* — Anh Mai
*Assistant Examiner* — Michael Santonocito
(74) *Attorney, Agent, or Firm* — Sughrue Mion, PLLC

(57) ABSTRACT

A field emission panel includes: a first glass plate which comprises a phosphor layer, a second glass plate which is disposed in parallel to the first glass plate and comprises a plurality of electron emission elements; and a sealing member which is interposed between the first and the second glass plates to seal a space between the first and the second glass plates, wherein a part of the sealing member is hidden inside the first and the second glass plates and the other part of the sealing member is exposed to outsides of the first and the second glass plates.

21 Claims, 12 Drawing Sheets

FIELD EMISSION PANEL, LIQUID CRYSTAL DISPLAY HAVING THE SAME, FIELD EMISSION DISPLAY HAVING THE SAME AND METHOD FOR PACKAGING FIELD EMISSION PANEL

CROSS-REFERENCE TO RELATED APPLICATION

This application claims priority from Korean Patent Application No. 10-2010-0082500, filed on Aug. 25, 2010, in the Korean Intellectual Property Office, the disclosure of which is incorporated herein by reference in its entirety.

BACKGROUND

1. Field

Methods and apparatuses consistent with exemplary embodiments relate to a field emission panel, a liquid crystal display (LCD) having the same, a field emission display having the same, and a method for packaging a field emission panel.

2. Description of the Related Art

A field emission element refers to a material that emits electrons when an electric field is generated around the material in a vacuum atmosphere, and a representative example thereof is a carbon nano tube. Using such a field emission element, a panel generating light may be manufactured. The panel of this type will be called a "field emission panel" hereinbelow.

The field emission panel generally includes a pair of glass plates arranged in parallel. One of the glass plates is provided with a phosphor layer and an anode electrode, whereas the other glass plate is provided with a plurality of field emission elements and a cathode electrode. If an electric field is generated between the anode electrode and the cathode electrode, the field emission elements emit electrons toward the phosphor layer. When the electrons collide with the phosphor layer, light is emitted from the phosphor layer.

The light emitted from the field emission panel may be white light or polychromatic light according to the type of the phosphor layer. The field emission panel generating the white light may be used as a backlight unit for an LCD, and the field emission panel generating the polychromatic light may be used as a display panel of a field emission display.

It is preferable that a non-emissive area of the field emission panel used as a backlight unit or a display panel, that is, an area which is not coated with the phosphor layer is made as small as possible. As the non-emissive area is smaller, a size of a non-screen area of a display, which has nothing to do with displaying an image, can be further reduced.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide a field emission panel having a non-emissive area reduced, a liquid crystal display (LCD) having the same, a field emission display having the same, and a method for packaging a field emission panel.

According to a first aspect, there is provided a field emission panel including: a first glass plate which includes a phosphor layer, a second glass plate which is disposed in parallel to the first glass plate and includes a plurality of electron emission elements, and a sealing member which is interposed between the first and the second glass plates to seal a space between the first and the second glass plates, wherein a part of the sealing member is hidden inside the first and the second glass plates and the other part of the sealing member is exposed to outsides of the first and the second glass plates.

The sealing member may include a first attachment surface attached to the first glass plate and a second attachment surface attached to the second glass plate, and the first attachment surface may be bonded to the first glass plate by a first seal frit and the second attachment surface may be bonded to the second glass plate by a second seal frit.

Each of the first seal frit and the second seal frit may include an inner sealing part disposed inside the first and the second glass plates and an outer sealing part disposed outside the first and the second glass plates.

The outer sealing part of the first seal frit may be bonded to an edge surface of the first glass plate and the first attachment surface of the sealing member, and the outer sealing part of the second seal frit may be bonded to an edge surface of the second glass plate and the second attachment surface of the sealing member.

The sealing member may have a rectangular annular or frame-like shape.

According to a second aspect, there is provided a liquid crystal display (LCD) including: a field emission panel according to the first aspect, in which a phosphor layer includes red-phosphors, green-phosphors, and blue-phosphors which are distributed without a specific pattern, a liquid crystal panel which is disposed in front of the field emission panel to convert white light generated from the field emission panel into a color image, and a housing which houses the field emission panel and the liquid crystal panel, According to a third aspect of another exemplary embodiment, there is provided a field emission display including: a field emission panel according to the second aspect, in which a phosphor layer includes a plurality of phosphor groups which are distributed with a specific pattern, each phosphor including a red-phosphor, a green-phosphor, and a blue-phosphor, and a housing which houses the field emission panel.

According to a fourth aspect, there is provided a method for packaging a field emission panel, the method including: preparing a first glass plate including a phosphor layer, a second glass plate including electron emission elements, and a sealing member, coating attachment surfaces of the sealing member with a seal frit, placing the first glass plate and the second glass plate in parallel and aligning the sealing member between the first and the second glass plates so that the attachment surfaces are partly exposed to outsides of the first and the second glass plates, and sintering the first and the second glass plates between which the sealing member is interposed at a temperature higher than a melting point of the seal frit for a predetermined time and then cooling the first and the second glass plates at a temperature lower than the melting point of the seal frit for a predetermined time.

According to a fifth aspect, there is provided a method for packaging a field emission panel, the method including: preparing a first glass plate including a phosphor layer, a second glass plate including electron emission elements, and a sealing member, coating a first attachment surface and a second attachment surface of the sealing member with a seal frit, aligning the sealing member on the first glass plate so that a part of the first attachment surface is exposed to an outside of the first glass plate, sintering the first glass plate and the sealing member at a temperature higher than a melting point of the seal frit for a predetermined time and then cooling the first glass plate and the sealing member at a temperature lower than the melting point of the seal frit for a predetermined time, aligning the second glass plate with respect to the sealing member and the first glass plate so that the second glass plate is in parallel to the first glass plate and a part of the second attachment surface is exposed to an outside of the second glass plate, and sintering the first and the second glass plates and the sealing member at a temperature higher than a melting point of the seal frit for a predetermined time and then cooling the first and the second glass plates and the sealing member at a temperature lower than the melting point of the seal frit for a predetermined time.

In an exemplary embodiment, there is a field emission panel including: a first glass plate which includes a phosphor layer; a second glass plate which is parallel to the first glass plate and includes a plurality of electron emission elements; and a seal member which is interposed between the first and the second glass plates to seal a space between the first and the second glass plates, wherein a part of the seal member is disposed between the first and the second glass plates so as to be hidden inside the field emission panel and another part of the seal member is exposed to an outside of the field emission panel.

In yet another exemplary embodiment, there is a liquid crystal display (LCD) including: a field emission panel including: a first glass plate including a phosphor layer, the phosphor layer including red-phosphors, green-phosphors, and blue-phosphors which are distributed therein, a second glass plate disposed in parallel to the first glass plate and, the second glass plate including a plurality of electron emission elements, and a seal member interposed between the first and the second glass plates to seal a space between the first and the second glass plates, the phosphor layer including red-phosphors, green-phosphors, and blue-phosphors which are distributed without a specific pattern; a liquid crystal panel which is disposed in front of the field emission panel to convert which converts white light generated from the field emission panel into a color image; and a housing which houses the field emission panel and the liquid crystal panel, wherein a part of the seal member is hidden inside disposed between the first and the second glass plates so as to be hidden inside the field emission panel and the other another part of the seal member is exposed to outsides of the first and the second glass plates disposed outside of the field emission panel.

In an exemplary embodiment, there is a field emission display including: a field emission panel which includes: a first glass plate including a phosphor layer, the phosphor layer including a plurality of phosphor groups which are distributed in a pattern, each of the plurality of phosphor groups including a red-phosphor, a green-phosphor, and a blue-phosphor, a second glass plate parallel to the first glass plate, the second glass plate including a plurality of electron emission elements, and a seal member interposed between the first and the second glass plates to seal a space between the first and the second glass plates; and a housing which houses the field emission panel, wherein a part of the seal member is disposed between the first and the second glass plates so as to be hidden inside the field emission panel and another part of the seal member is exposed to an outside of the field emission panel.

In yet another exemplary embodiment, there is a method for packaging a field emission panel, the method including: preparing a first glass plate including a phosphor layer, a second glass plate including electron emission elements, and a seal member; coating attachment surfaces of the seal member with a seal frit; placing the first glass plate and the second glass plate in parallel and aligning the seal member between the first and the second glass plates so that the attachment surfaces partly extend out from sides of the first and the second glass plates; and sintering the first and the second glass plates between which the seal member is interposed at a temperature higher than a melting point of the seal frit for a predetermined time and cooling the first and the second glass plates at a temperature lower than the melting point of the seal frit for a predetermined time.

In another exemplary embodiment, there is a method for packaging a field emission panel, the method including: preparing a first glass plate including a phosphor layer, a second glass plate including electron emission elements, and a seal member; coating a first attachment surface and a second attachment surface of the seal member with a seal frit; aligning the seal member on the first glass plate so that a part of the first attachment surface extend out from sides of the first glass plate; sintering the first glass plate and the seal member at a temperature higher than a melting point of the seal frit for a predetermined time and cooling the first glass plate and the seal member at a temperature lower than the melting point of the seal frit for a predetermined time; aligning the second glass plate with respect to the seal member and the first glass plate so that the second glass plate is in parallel to the first glass plate and a part of the second attachment surface extend out from sides of the second glass plate; and sintering the first and the second glass plates and the seal member at a temperature higher than a melting point of the seal frit for a predetermined time and then cooling the first and the second glass plates and the seal member at a temperature lower than the melting point of the seal frit for a predetermined time.

In another exemplary embodiment, there is a field emission panel including: a first glass plate which includes a phosphor layer; a second glass plate which is coplanar to the first glass plate and includes a plurality of electron emission elements; and a frame which is disposed between the first and the second glass plates to form an enclosed space between the first and the second glass plates, wherein an inner portion of the frame overlaps with the first and the second glass plates so as to be disposed in between the first and the second glass plates and an outer portion of the frame protrudes out from sides of the first and the second glass plates.

Additional aspects and advantages of the exemplary embodiments will be set forth in the detailed description, will be obvious from the detailed description, or may be learned by practicing the exemplary embodiments.

BRIEF DESCRIPTION OF THE DRAWINGS

The above and/or other aspects will be more apparent by describing in detail exemplary embodiments, with reference to the accompanying drawings, in which.

DETAILED DESCRIPTION OF THE EXEMPLARY EMBODIMENTS

Figure 1:
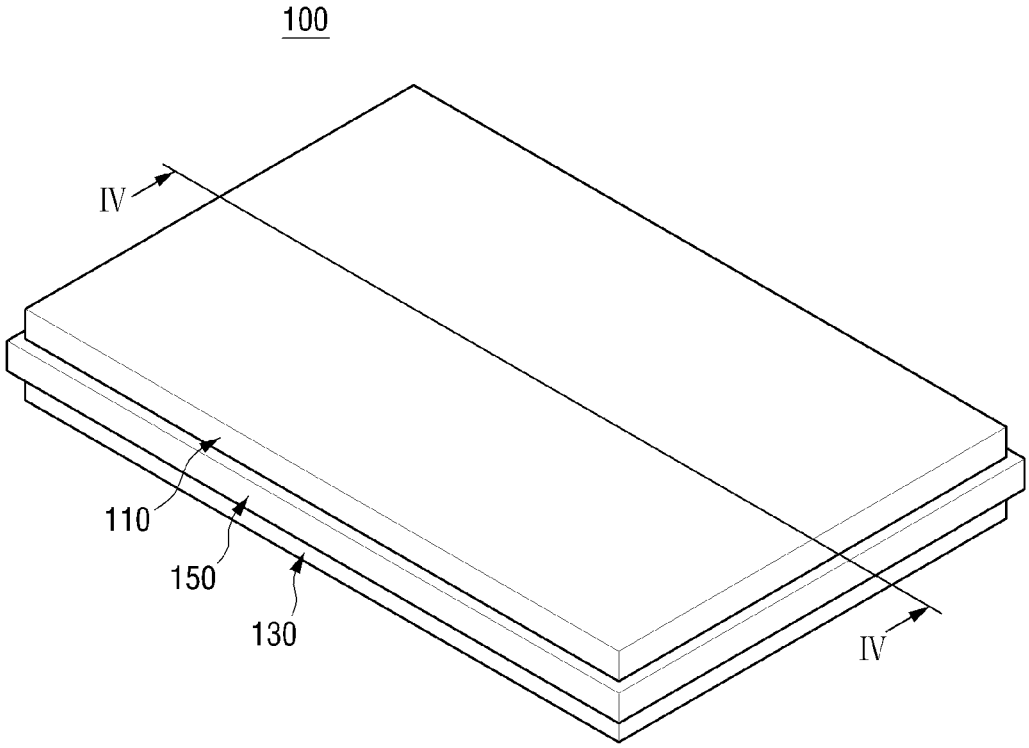
FIG. 1 is a schematic perspective view illustrating a field emission panel according to an exemplary embodiment.

Hereinafter, exemplary embodiments will be described in greater detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

Hereinafter, a field emission panel according to an exemplary embodiment will be explained with reference to FIGS. 1 to 7.

Figure 2:
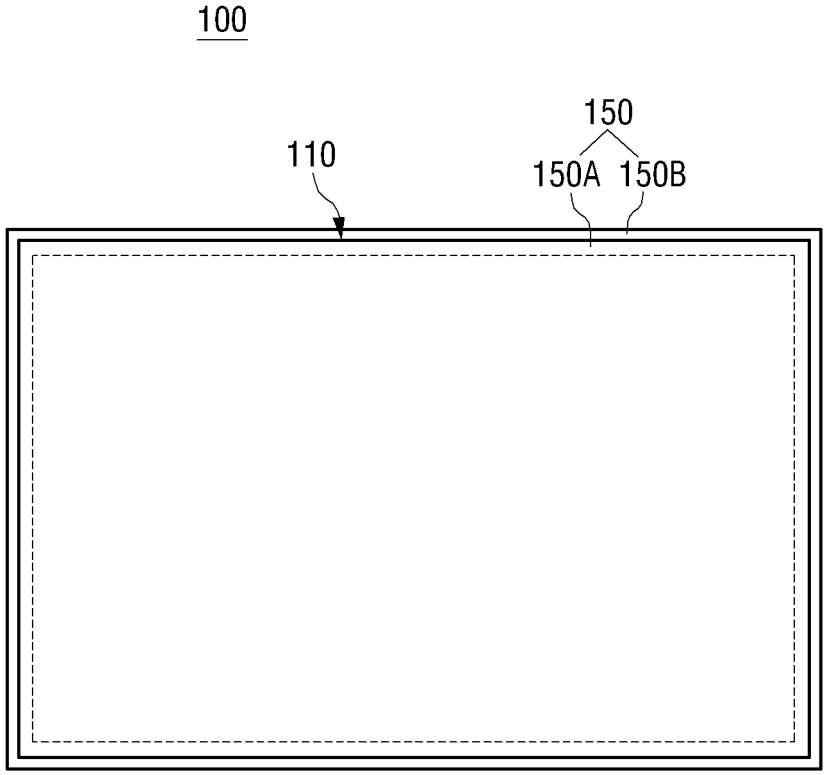
FIG. 2 is a plan view of the field emission panel of FIG. 1.
Figure 3:
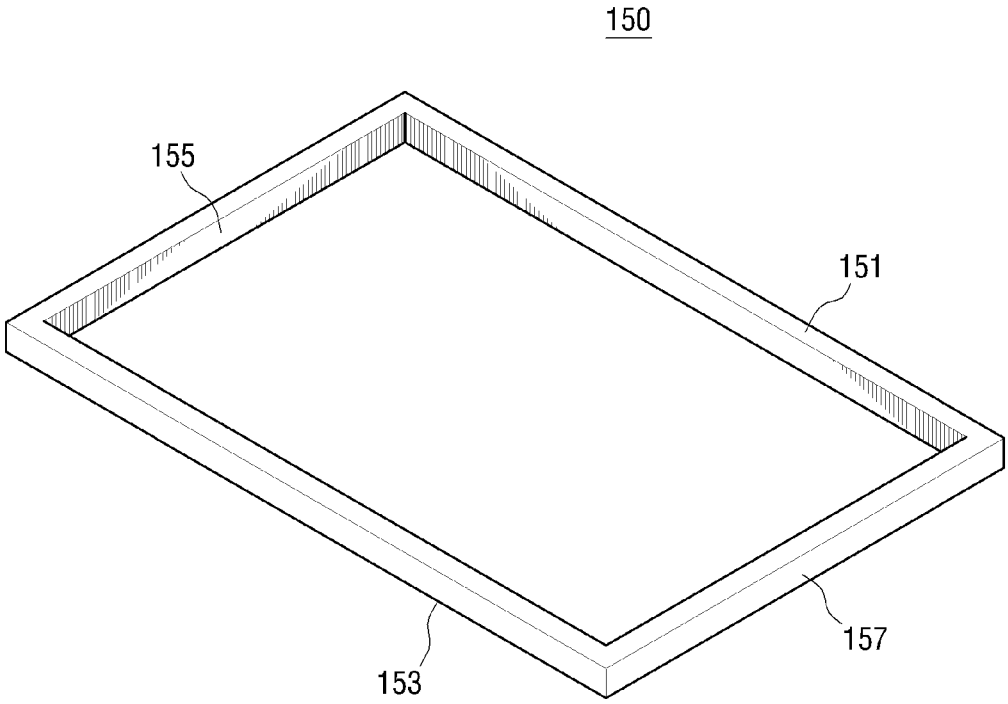
FIG. 3 is a schematic perspective view illustrating a sealing member of the field emission panel of FIG. 1.
Figure 4:
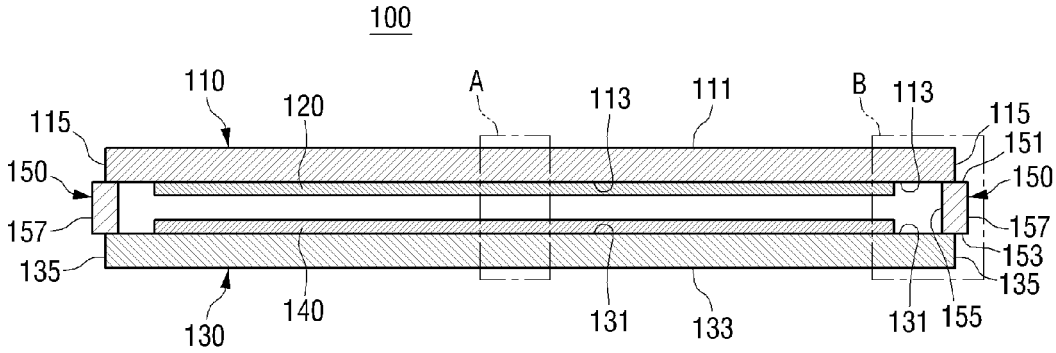
FIG. 4 is a schematic cross section view taken along line IV-IV of FIG. 1.
Figure 5:
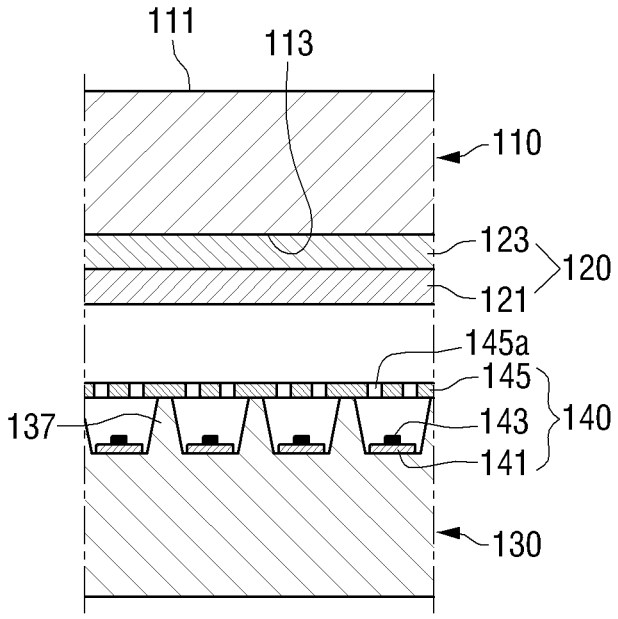
FIG. 5 is an enlarged cross-section view of the part A of FIG. 4.

FIG. 1 is a schematic perspective view illustrating a field emission panel according to an exemplary embodiment, FIG. 2 is a plan view of the field emission panel of FIG. 1, FIG. 3 is a schematic perspective view of a sealing member included in the field emission panel of FIG. 1, FIG. 4 is a schematic cross-section view taken along line IV-IV of FIG. 1, and FIG. 5 is an enlarged view of the part A of FIG. 4.

Referring to FIGS. 1 to 5, a field emission panel 100 according to an exemplary embodiment includes a first glass plate (or an upper plate) 110, a second glass plate (or a lower plate) 130, and a sealing member 150.

The upper plate 110 is formed of a glass material having high light transmissivity. The upper plate 110 has a rectangular plate shape. As shown in FIG. 4, the upper plate 110 includes an upper surface (or an outer surface) 111 and a lower surface (or an inner surface) 113 having relatively large sizes, and four edge surfaces (or end surfaces) 115 having relatively small sizes. As shown in FIG. 4, a light emission part 120 is provided on the inner surface 113 of the upper plate 110. As shown in FIG. 5, the light emission part 120 includes an anode electrode 121 and a phosphor layer 123.

The lower plate 130 is arranged in parallel to the above-described upper plate 110. Like the upper plate 110, the lower plate 130 is formed of a glass material having high light transmissivity and has a rectangular plate shape. Accordingly, as shown in FIG. 4, the lower plate 130 includes an upper surface (or an inner surface) 131 and a lower surface (or an outer surface) 133 having relatively large sizes, and four edge surfaces (or end surfaces) 135 having relatively small sizes. As shown in FIG. 4, an electron emission part 140 is provided on the inner surface 131 of the lower plate 130. As shown in FIG. 5, the electron emission part 140 includes a plurality of cathode electrodes 141, a plurality of electron emission elements 143, and a gate electrode 145.

The two adjacent cathode electrodes 141 are separated from each other by a partition 137 formed on the lower plate 130. The plurality of electron emission elements 143 are mounted on one cathode electrode 141. The electron emission elements 143 are formed of a carbon nano tube. Alternatively, the electron emission element 143 may be formed of a material that emits electrons when an electric field is generated around the material in a vacuum condition, such as graphite, graphite nano fiber, diamond, diamond-like carbon (DLC), fullerene, or silicon nano-fiber. The gate electrode 145 has a plurality of holes 145*a* through which the electrons emitted from the electron emission elements 143 pass.

When voltage is applied to the cathode electrodes 141, the gate electrode 145, and the anode electrode 121, the electric field necessary for the emission and acceleration of the electrons is generated. In other words, the electrons are emitted from the electron emission elements 143 due to the electric field generated between the cathode electrodes 141 and the gate electrode 145, and the emitted electrons are accelerated toward the phosphor layer 123 due to the electric field generated between the gate electrode 145 and the anode electrode 121. When the accelerated electrons collide with the phosphor layer 123, light is generated from the phosphor layer 123.

The phosphor layer 123 includes a red-phosphor corresponding red light, a green-phosphor corresponding to green light, and a blue-phosphor corresponding blue right. According to an exemplary embodiment, these three types of phosphors of the phosphor layer 123 may be uniformly distributed over the upper plate 110 without a specific pattern, and white light may be generated from such a phosphor layer 123. The field emission panel 100 having the phosphor layer 123 for generating white light may be used as a backlight unit for a display (in particular, a liquid crystal display (LCD)). According to another exemplary embodiment, the three types of phosphors may be distributed over the upper plate 110 with a specific pattern. For example, a number of phosphor groups each consisting of the red-phosphor, the green-phosphor, and the blue-phosphor may be distributed over the upper plate 110 in a regular pattern. Polychromatic light may be generated from the phosphor layer 123 of this type and thus a color image can be realized. The field emission panel 100 having the phosphor layer 123 for realizing the color image may be used as a display panel of a field emission display.

The sealing member 150 is formed of a glass material like the glass plates 110 and 130. As shown in FIG. 3, the sealing member 150 has a rectangular annular shape or a rectangular frame-like shape and includes an upper surface 151, a lower surface 153, an inner surface 155, and an outer surface 157. As shown in FIG. 4, the upper surface 151 of the sealing member 150 is attached to the upper plate 110 and the lower surface 153 of the sealing member 150 is attached to the lower plate 130. Hereinafter, the upper surface 151 of the sealing member 150 will be referred to as a first attachment surface 151 and the lower surface 153 of the sealing member 150 will be referred to as a second attachment surface 153. As shown in FIGS. 1 and 4, the sealing member 150 of the annular or frame-like shape is interposed between the upper plate 110 and the lower plate 130 so that a space between the upper plate 110 and the lower plate 130 is sealed.

As shown in FIG. 2, a part 150A of the sealing member 150 is hidden inside the upper plate 110 and the lower plate 130 and the other part 150B is exposed to the outside of the upper plate 110 and the lower plate 130. This will be explained in detail with reference to FIGS. 6 and 7.

Figure 6:
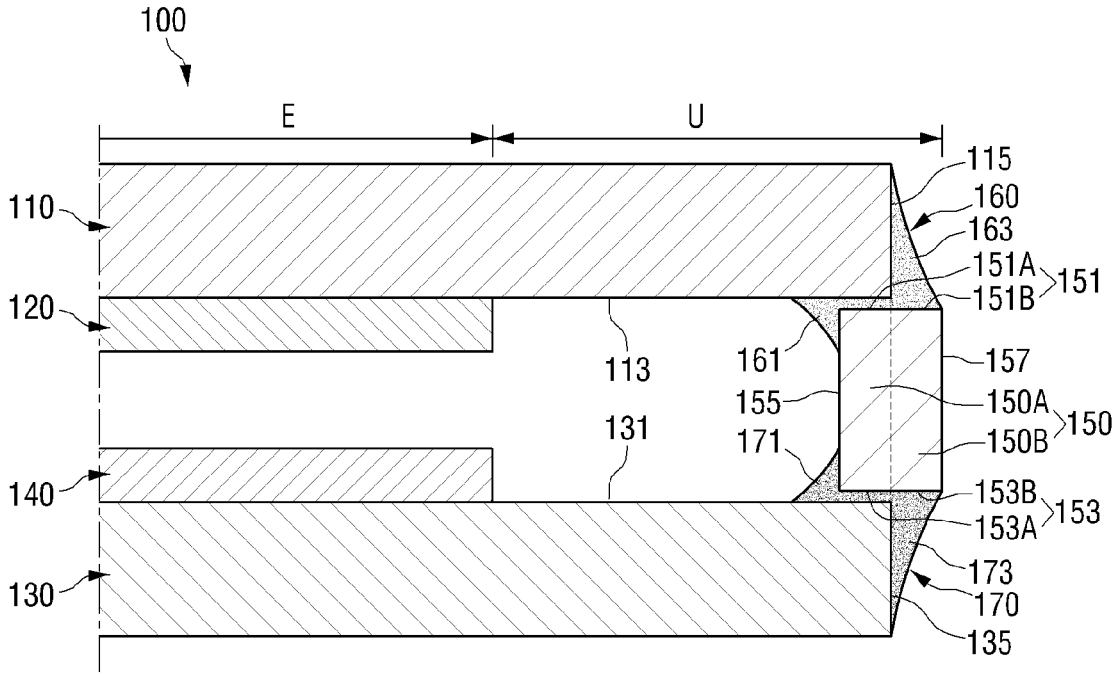
FIG. 6 is an enlarged cross-section view of the part B of FIG. 4.
Figure 7:
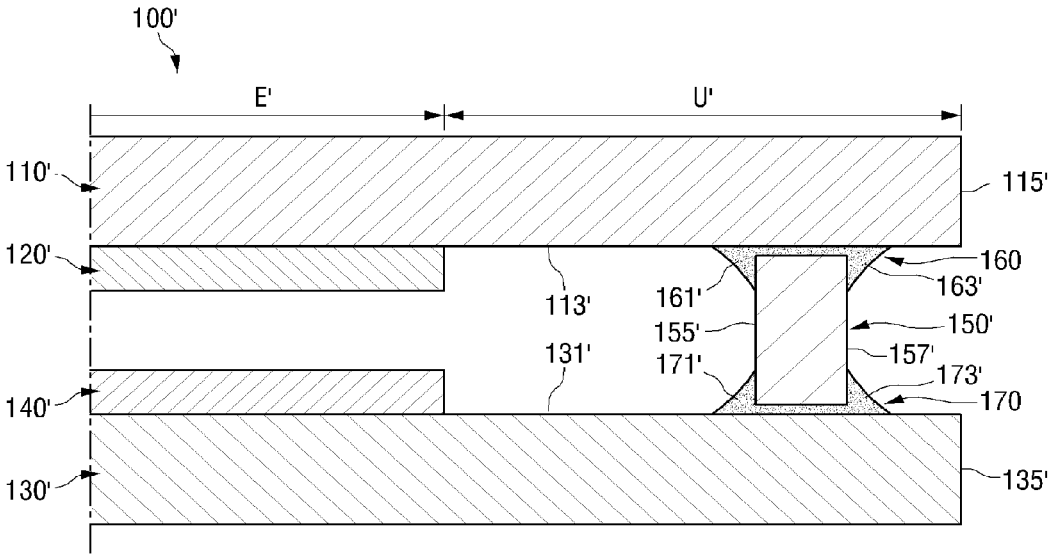
FIG. 7 Related Art
FIG. 7 is a view similar to FIG. 6, illustrating a general field emission panel.

FIG. 6 is an enlarged cross-section view of the part B of FIG. 4, and FIG. 7 is a cross-section view similar to FIG. 6, illustrating a general field emission panel.

Referring to FIG. 6, the sealing member 150 has the part 150A which is hidden inside the upper plate 110 and the lower plate 130, that is, a part contacting the upper plate 110 and the lower plate 130, and the part 150B which is exposed to the outside of the upper plate 110 and the lower plate 130, that is, a part protruding from the upper plate 110 and the lower plate 130 and not contacting the upper plate 110 and the lower plate 130. Therefore, the first attachment surface 151 of the sealing member 150 has a part 151A hidden inside the upper plate 110 and a part 151B exposed to the outside of the upper plate 110. Also, the second attachment surface 153 of the sealing member 150 has a part 153A hidden inside the lower plate 130 and a part 153B exposed to the outside of the lower plate 130.

A first seal frit 160 is formed on the first attachment surface 151 of the sealing member 150 to airtightly attach the first attachment surface 151 to the upper plate 110, and a second seal frit 170 is formed on the second attachment surface 153 of the sealing member 150 to airtightly attach the second attachment surface 153 to the lower plate 130. By the first and the second seal fits 160 and 170, the sealing member 150 may be bonded to the upper plate 110 and the lower plate 130 and also gaps between the sealing member 150 and the upper and the lower plates 110 and 130 are sealed. The first and the second seal frits 160 and 170 are formed of a kind of glass and their melting points are lower than melting points of the upper plate 110, the lower plate 130 and the sealing member 150.

The first seal frit 160 includes an inner sealing part 161 and an outer sealing part 163. The inner sealing part 161 is disposed inside the upper plate 110 and performs an inner sealing by being bonded to the inner surface 113 of the upper plate 110 and the inner surface 155 of the sealing member 150. The outer sealing part 163 is disposed outside the upper plate 110 and performs an outer sealing by being bonded to the edge surface 115 of the upper plate 110 and the part 151B of the first attachment surface 151 of the sealing member 150. The first seal frit 160 performs double-sealing using the inner sealing part 161 and the outer sealing part 163, thereby guaranteeing secure sealing between the upper plate 110 and the sealing member 150.

Similarly, the second seal frit 170 includes an inner sealing part 171 and an outer sealing part 173, and performs double-sealing using the inner sealing part 171 and the outer sealing part 173, thereby guaranteeing secure sealing between the lower plate 130 and the sealing member 150.

A general field emission panel 100' of FIG. 7 is different from the field emission panel 100 of the present disclosure in that a sealing member 150' is completely hidden inside an upper plate 110' and a lower plate 130'. Furthermore, the general field emission panel 110' is different from the field emission panel 110 in that an outer sealing part 163' of a first seal frit 160' is bonded to an inner surface 113' of the upper plate 110' and an outer surface 157' of the sealing member 150', and that an outer sealing part 173' of a second seal frit 170' is bonded to an inner surface 131' of the lower plate 130' and an outer surface 157' of the sealing member 150'.

Comparing the field emission panel 100 of FIG. 6 and the general field emission panel 100' of FIG. 7, light-emitting areas E and E' of the field emission panel 100 and 100' have the same size, but the non-emissive area U of the field emission panel 100 of FIG. 6 is smaller than the non-emissive area U' of the field emission panel 100' of FIG. 7. Herein, the light-emitting area E refers to an area of the field emission panel 100 where the light emission part 120 is arranged and thus light is generated, whereas the non-emissive area U refers to the other area of the field emission panel 100 where the light emission part 120 is not arranged and thus light is not generated.

The reason why the non-emissive area U of the field emission panel 110 of the present disclosure is smaller than the non-emissive area U' of the general field emission panel 100' is that the upper and the lower plates 110 and 130 of the field emission panel 100 partly hide the sealing member 150, rather than completely hiding the sealing member 150 as in the general field emission panel 100', and thus the upper and the lower plates 110 and 130 of the field emission panel 100 of the present disclosure are smaller than the upper and the lower plates 110' and 130' of the general field emission panel 100'.

The light-emitting area E of the field emission panel 110 of the present discourse is the same as that of the general field emission panel 100', but the non-emissive area U of the field emission panel 100 of the present disclosure is smaller than that of the general field emission panel 100'. Therefore, if the field emission panel 110 of the present disclosure is applied to a display such as an LCD or a field emission display, an area of the display that does not display an image, that is, a non-screen area is relatively small, compared to a general display.

Figure 8:
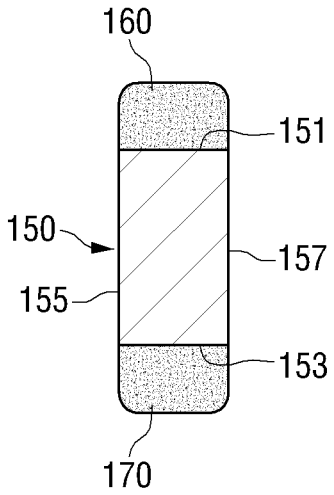
FIG. 8 is a cross-section view to show an operation of coating seal frits on the sealing member.
Figure 9:
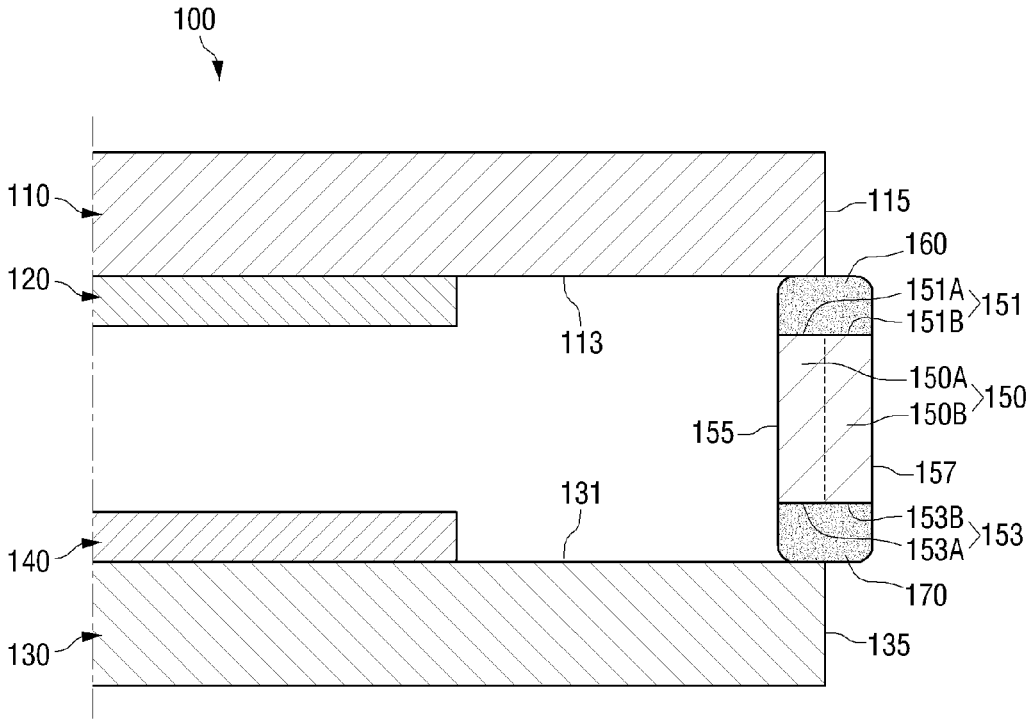
FIG. 9 is a cross-section view to show an operation of arranging the sealing member between an upper plate and a lower plate.
Figure 10:
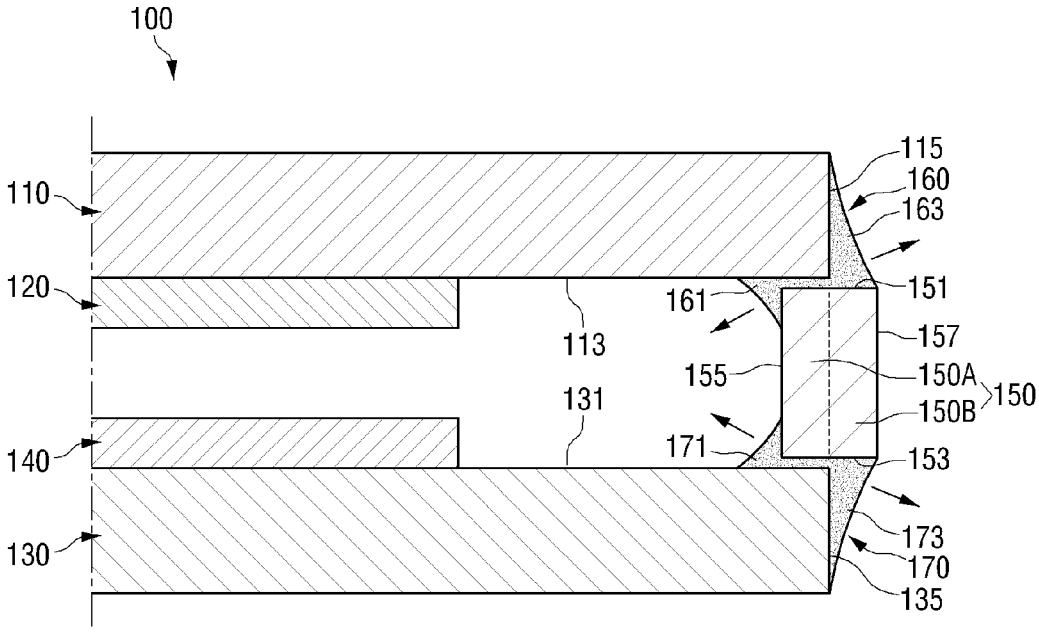
FIG. 10 is a cross-section view to show an operation of sintering the seal frits interposed between the upper and the lower plates and the sealing member.

FIGS. 8 to 10 are views to explain a method for packaging a field emission panel according to an exemplary embodiment. FIG. 8 is a cross-section view to show an operation of coating seal frits on the sealing member, FIG. 9 is a cross-section view to show an operation of arranging the sealing member between the upper plate and the lower plate, and FIG. 10 is a cross-section view to show an operation of sintering the seal fits interposed between the upper and the lower plates and the sealing member.

Hereinafter, a method for packaging a field emission panel according to an exemplary embodiment will be explained with reference to FIGS. 8 to 10.

First, the upper plate (first glass plate) 110, the lower plate (second glass plate) 130, and the sealing member 150 are prepared. The light emission part 120 is provided on the inner surface 113 of the upper plate 110, and the electron emission part 140 is provided on the inner surface 131 of the lower plate 130.

Next, the first seal frit 160 and the second seal frit 170, which are in a solid state, are coated over the first attachment surface 151 and the second attachment surface 153 of the sealing member 150, as shown in FIG. 8.

Next, the upper plate 110 and the lower plate 130 are arranged in parallel to each other and the sealing member 150 is arranged therebetween, as shown in FIG. 9. At this time, the part 150A of the sealing member 150 is hidden inside the upper and the lower plates 110 and 130 and the other part 150B is exposed to the outside of the upper and the lower plates 110 and 130. Similarly, the parts 151A and 153A of the first and the second attachment surfaces 151 and 153 of the sealing member 150 are hidden inside the upper and the lower plates 110 and 130 and the other parts 151B and 153B are exposed to the outside of the upper and the lower plates 110 and 130. Also, the first and the second attachment surfaces 151 and 153 of the sealing member 150 are arranged in parallel to the upper and the lower plates 110 and 130, and the first seal frit 160 and the second seal frit 170 contact the inner surface 113 of the upper plate 110 and the inner surface 131 of the lower plate 130, respectively.

Next, the upper and the lower plates 110 and 130 between which the sealing member 150 is interposed are clamped and are placed in a sintering furnace, and then are sintered at a temperature exceeding a melting point of the first and the second seal frits 160 and 170 for a predetermined time. Then, as shown in FIG. 10, the first seal frit 160 and the second seal frit 170 become gel-like and have viscosity. At this time, a part of the first seal frit 160 flows inward of the upper plate 110, thereby forming the inner sealing part 161 and the other part of the first seal frit 160 flows outward of the upper plate 110, thereby forming the outer sealing part 163. In the same manner, a part of the second seal frit 170 flows inward of the lower plate 130, thereby forming the inner sealing part 171, and the other part of the second seal frit 170 flows outward of the lower plate 130, thereby forming the outer sealing part 173. It should be noted that the outer sealing parts 163 and 173 of the first and the second seal fits 160 and 170 are attached to the edge surfaces 115 and 135 of the upper and the lower plates 110 and 130, rather than to the inner surfaces 113 and 131 of the upper and the lower plates 110 and 130.

Next, the upper and the lower plates 110 and 130 between which the sealing member 150 is interposed are cooled at a temperature lower than the melting points of the first and the second seal fits 160 and 170. Then, the first and the second seal frits 160 and 170 change from gel to solid so that the upper and the lower plates 10 and 130 and the sealing member 150 are bonded to each other by the first and the second seal fits 160 and 170.

Next, the space in the field emission panel 100 is vacuumized by exhausting air in the field emission panel 100 through an exhaust hole (not shown) formed on the upper plate 110 or the lower plate 130. The process of packaging the field emission panel 100 is completed by performing the exhausting operation.

According to the method for packaging the field emission panel described above, the sealing member 150 is bonded to the upper and the lower plates 110 and 130 simultaneously. However, as an alternative, the sealing member 150 may be bonded to one (for example, the upper plate) of the upper plate and the lower plates 110 and 130 first, and may be then bonded to the other one (for example, the lower plate). The method for packaging by bonding the sealing member 150 to the upper and the lower plate 110 and 130 in sequence is more advantageous than the method of bonding the sealing member 150 to the upper and the lower plates 110 and 130 simultaneously, in that the sealing member 150 can aligned more easily with respect to the upper and the lower plates 110 and 130.

Figure 11:
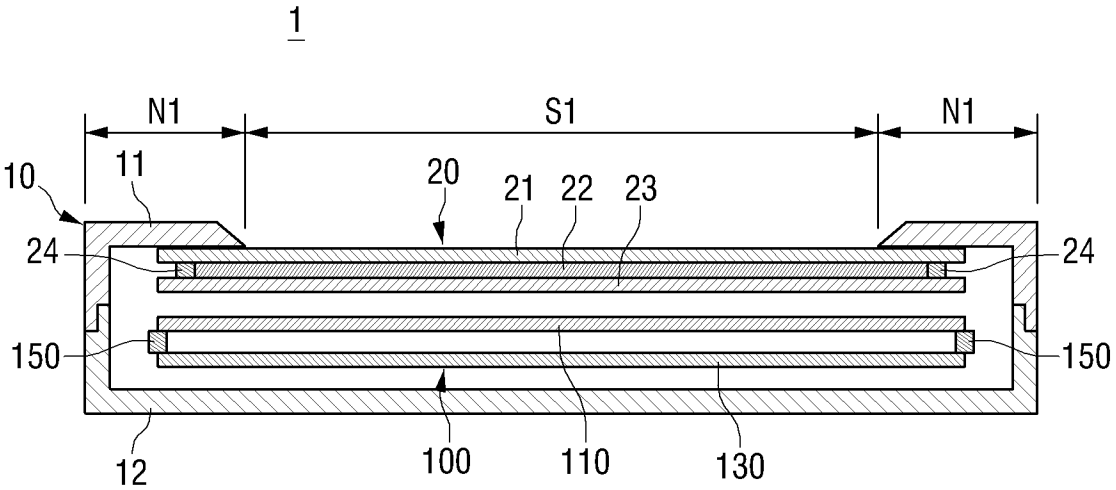
FIG. 11 is a schematic cross-section view illustrating an LCD according to an exemplary embodiment.

FIG. 11 is a schematic cross-section view illustrating an LCD according to an exemplary embodiment.

Referring to FIG. 11, an LCD 1 includes a housing 10, a liquid crystal panel 20, and the field emission panel 100 described above.

The housing 10 houses therein the components of the LCD including the liquid crystal panel 20 and the field emission panel 100. The housing 10 includes a front housing 11 and a rear housing 12, and the front housing 11 has an opening to expose a screen area S1 to the outside.

The liquid crystal panel 20 includes a color filter substrate 21 on which a color filter layer is formed and a film transistor substrate 23 where a film transistor is formed, and a space between the two substrates 21 and 23 is filled with a liquid crystal layer 22. The color filter substrate 21 and the film transistor substrate 23 are sealed and bonded to each other by a sealant 24.

The field emission panel 100 is disposed on a rear surface of the liquid crystal panel 20 to generate light and project the light onto the liquid crystal panel 20. An amount of light is adjusted when the light projected onto the liquid crystal panel 20 passes through the liquid crystal layer 22, and the light is converted into a color image by the color filter substrate 21.

The field emission panel 100 described above may be used as a backlight unit for the LCD 1. In this case, the phosphor layer 123 (see FIG. 5) provided on the upper plate 110 of the field emission panel 100 generate white light. Therefore, the phosphor layer 123 on which red-phosphors, green-phosphors, and blue-phosphors are distributed without a regular pattern is applied.

The field emission panel 100 described above has the non-emissive area U (see FIG. 6) further reduced in comparison with the general field emission panel 100'. Therefore, in the LCD 1 for which the field emission panel 100 is used as a backlight unit, a non-screen area N1 can be reduced as much as the non-emissive area U is reduced.

Figure 12:
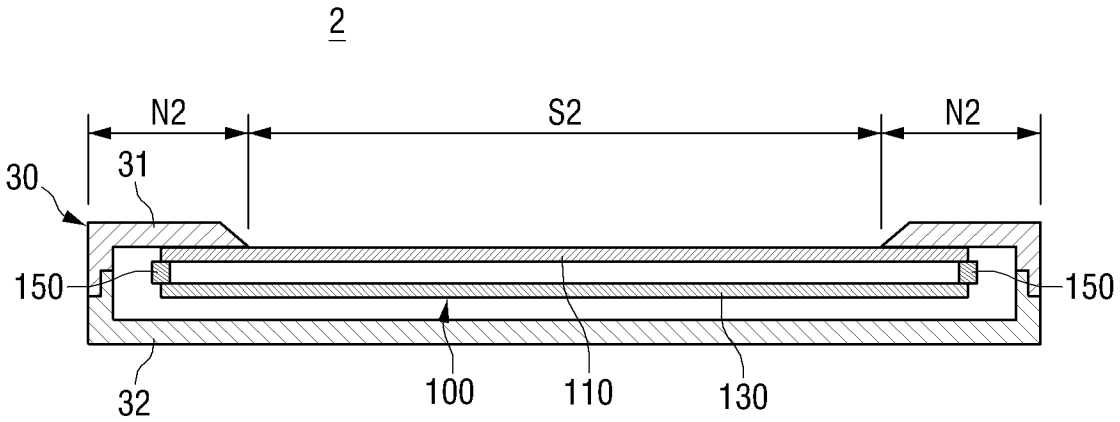
FIG. 12 is a schematic cross-section view illustrating a field emission display according to an exemplary embodiment.

FIG. 12 is a schematic cross-section view of a field emission display according to an exemplary embodiment.

Referring to FIG. 12, a field emission display 2 includes a housing 30 and the field emission panel 100 described above.

The housing 30 houses therein the components of a display apparatus including the field emission panel 100. The housing 30 includes a front housing 31 and a rear housing 32, and the front housing 31 has an opening to expose a screen area S2 to the outside.

The field emission panel 100 is a display panel that realizes a color image without the assistance of a backlight unit. Therefore, the phosphor layer 123 (see FIG. 5) provided on the upper plate 110 of the field emission panel 100 has to generate polychromatic light. Accordingly, the phosphor layer 123 on which a large number of phosphor groups consisting of red-phosphors, green-phosphors, and blue-phosphors are distributed with a regular pattern is applied.

As described above, the non-emissive area U (see FIG. 6) of the field emission panel 100 is further reduced in comparison with that of the general field emission panel 100'. Therefore, in the field emission display 2 to which the field emission panel 100 is applied as a display panel, a non-screen area N2 can be reduced as much as the non-emissive area U is reduced.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A field emission panel comprising:

a first glass plate which comprises a phosphor layer;

a second glass plate extends in a parallel direction with respect to the first glass plate and comprises a plurality of electron emission elements; and a one-piece seal member which is interposed between the first and the second glass plates to seal a space between the first and the second glass plates, wherein a part of the seal member is disposed between the first and the second glass plates so as to be hidden inside the field emission panel and another part of the seal member protruding from the first and second glass plate in the parallel direction and is exposed to an outside of the field emission panel, wherein the seal member comprises a first attachment surface attached to the first glass plate and a second attachment surface attached to the second glass plate, wherein the first attachment surface is bonded to the first glass plate by a first seal frit and the second attachment surface is bonded to the second glass plate by a second seal frit, and wherein the first seal frit and the second seal frit comprise inner sealing parts disposed inside the field emission panel and outer sealing parts disposed outside the field emission panel.

2. The field emission panel as claimed in claim 1, wherein the outer sealing part of the first seal frit is bonded to an edge surface of the first glass plate and the first attachment surface of the seal member, and the outer sealing part of the second seal frit is bonded to an edge surface of the second glass plate and the second attachment surface of the seal member.

3. The field emission panel as claimed in claim 1, wherein the seal member has a rectangular frame shape.

4. The field emission panel as claimed in claim 1, wherein the sealing member comprises a glass material.

5. The field emission panel as claimed in claim 1, wherein the first seal frits contacts the seal member and the first glass plate, and the second seal frits contacts the seal member and the second glass plate.

6. A liquid crystal display (LCD) comprising:

a field emission panel comprising:

a first glass plate comprising a phosphor layer, the phosphor layer comprising red-phosphors, green-phosphors, and blue-phosphors which are distributed therein, a second glass plate extending in a parallel direction with respect to the first glass plate, the second glass plate comprising a plurality of electron emission elements, and a one-piece seal member interposed between the first and the second glass plates to seal a space between the first and the second glass plates and protruding from the first and second glass plate in the parallel direction;

a liquid crystal panel disposed in front of the field emission panel which converts white light generated from the field emission panel into a color image; and a housing which houses the field emission panel and the liquid crystal panel, wherein a part of the seal member is disposed between the first and the second glass plates so as to be hidden inside the field emission panel and another part of the seal member is disposed outside of the field emission panel, wherein the seal member comprises a first attachment surface attached to the first glass plate and a second attachment surface attached to the second glass plate, wherein the first attachment surface is bonded to the first glass plate by a first seal frit and the second attachment surface is bonded to the second glass plate by a second seal frit, and wherein the first seal frit and the second seal frit comprise inner sealing parts disposed inside the field emission panel and an outer sealing part disposed outside the field emission panel.

7. The LCD as claimed in claim 6, wherein the outer sealing part of the first seal frit is bonded to an edge surface of the first glass plate and the first attachment surface of the seal member, and the outer sealing part of the second seal frit is bonded to an edge surface of the second glass plate and the second attachment surface of the seal member.

8. The LCD as claimed in claim 6, wherein the seal member has a rectangular frame shape.

9. The LCD as claimed in claim 6, wherein the sealing member comprises a glass material.

10. The LCD as claimed in claim 6, wherein the first seal frits contacts the seal member and the first glass plate, and the second seal frits contacts the seal member and the second glass plate.

11. A field emission display comprising:

a field emission panel which comprises:

a first glass plate comprising a phosphor layer, the phosphor layer comprising a plurality of phosphor groups which are distributed in a pattern, each of the plurality of phosphor groups comprising a red-phosphor, a green-phosphor, and a blue-phosphor, a second glass plate extending in a parallel direction with respect to the first glass plate, the second glass plate comprising a plurality of electron emission elements, and a one-piece seal member interposed between the first and the second glass plates to seal a space between the first and the second glass plates and protruding from the first and second glass plate in the parallel direction; and a housing which houses the field emission panel, wherein a part of the seal member is disposed between the first and the second glass plates so as to be hidden inside the field emission panel and another part of the seal member is exposed to an outside of the field emission panel, wherein the seal member comprises a first attachment surface attached to the first glass plate and a second attachment surface attached to the second glass plate, wherein the first attachment surface is bonded to the first glass plate by a first seal frit and the second attachment surface is bonded to the second glass plate by a second seal frit, and wherein the first seal frit and the second seal frit comprise inner sealing parts disposed inside the field emission panel and outer sealing parts disposed outside the field emission panel.

12. The field emission display as claimed in claim 11, wherein the outer sealing part of the first seal frit is bonded to an edge surface of the first glass plate and the first attachment surface of the seal member, and the outer sealing part of the second seal frit is bonded to an edge surface of the second glass plate and the second attachment of the seal member.

13. The field emission display as claimed in claim 11, wherein the seal member has a rectangular frame shape.

14. The field emission display as claimed in claim 11, wherein the sealing member comprises a glass material.

15. The field emission display as claimed in claim 11, the first seal frits contacts the seal member and the first glass plate, and the second seal frits contacts the seal member and the second glass plate.

16. A method for packaging a field emission panel, the method comprising:

preparing a first glass plate comprising a phosphor layer, a second glass plate comprising electron emission elements, and a seal member;

coating attachment surfaces of the seal member with a seal frit;

placing the first glass plate and the second glass plate in parallel and aligning the seal member between the first and the second glass plates so that the attachment surfaces partly extend out from sides of the first and the second glass plates in the parallel direction; and sintering the first and the second glass plates between which the seal member is interposed at a temperature higher than a melting point of the seal frit for a predetermined time and cooling the first and the second glass plates at a temperature lower than the melting point of the seal frit for a predetermined time.

17. A method for packaging a field emission panel, the method comprising:

preparing a first glass plate comprising a phosphor layer, a second glass plate comprising electron emission elements, and a seal member;

coating a first attachment surface and a second attachment surface of the seal member with a seal frit;

aligning the seal member on the first glass plate so that a part of the first attachment surface extend out from sides of the first glass plate;

sintering the first glass plate and the seal member at a temperature higher than a melting point of the seal frit for a predetermined time and cooling the first glass plate and the seal member at a temperature lower than the melting point of the seal frit for a predetermined time;

aligning the second glass plate with respect to the seal member and the first glass plate so that the second glass plate is in parallel to the first glass plate and a part of the second attachment surface extend out from sides of the second glass plate in the parallel direction; and sintering the first and the second glass plates and the seal member at a temperature higher than a melting point of the seal frit for a predetermined time and then cooling the first and the second glass plates and the seal member at a temperature lower than the melting point of the seal frit for a predetermined time.

18. A field emission panel comprising:

a first glass plate which comprises a phosphor layer;

a second glass plate which extends in a coplanar direction with respect to the first glass plate and comprises a plurality of electron emission elements; and a one-piece frame which is disposed between the first and the second glass plates to form an enclosed space between the first and the second glass plates, wherein an inner portion of the frame overlaps with the first and the second glass plates so as to be disposed in between the first and the second glass plates and an outer portion of the frame protrudes out from sides of the first and the second glass plates in the coplanar direction, wherein the frame comprises a first attachment surface attached to the first glass plate and a second attachment surface attached to the second glass plate, wherein a first hidden surface and a first exposed surface of the first attachment surface is bonded to the first glass plate by a first seal frit and a second hidden surface and a second exposed surface of the second attachment surface is bonded to the second glass plate by a second seal frit, and wherein the first seal frit and the second seal frit comprise inner sealing parts disposed inside the field emission panel and outer sealing parts disposed outside the field emission panel.

19. The field emission panel of claim 18, wherein the first and the second glass plates and the frame are coplanarly disposed so that at least one of a planar width or planar length of the frame is larger than a corresponding at least one of a planar width or planar length of the first glass plate.

20. The field emission panel of claim 18, wherein the frame comprises a glass material.

21. The field emission panel of claim 18, wherein the first seal frits contacts the frame and the first glass plate, and the second seal frits contacts the frame and the second glass plate.

* * * * *